US007189114B1

(12) United States Patent
Burris et al.

(10) Patent No.: US 7,189,114 B1
(45) Date of Patent: Mar. 13, 2007

(54) COMPRESSION CONNECTOR

(75) Inventors: Donald Andrew Burris, Peoria, AZ (US); Jimmy Ciesla Henningsen, Homegaard (DK); William Bernard Lutz, Glendale, AZ (US); Thomas Dewey Miller, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/478,863

(22) Filed: Jun. 29, 2006

(51) Int. Cl.
*H01R 9/05* (2006.01)

(52) U.S. Cl. ..... 439/578

(58) Field of Classification Search ..... 439/578, 439/583, 874, 675, 879
See application file for complete search history.

(56) References Cited

U.S. PATENT DOCUMENTS

| | | | | |
|---|---|---|---|---|
| 3,622,939 | A * | 11/1971 | Forney, Jr. | 439/322 |
| 4,165,911 | A * | 8/1979 | Laudig | 439/314 |
| 4,346,958 | A | 8/1982 | Blanchard | 339/177 R |
| 4,662,693 | A * | 5/1987 | Hutter et al. | 439/583 |
| 4,676,577 | A | 6/1987 | Szegda | 439/584 |
| 4,696,532 | A | 9/1987 | Mattis | 439/863 |
| 4,842,553 | A * | 6/1989 | Ingram | 439/583 |
| 4,854,893 | A | 8/1989 | Morris | 439/578 |
| 4,952,174 | A | 8/1990 | Sucht et al. | 439/584 |
| 5,011,432 | A | 4/1991 | Sucht et al. | 439/584 |
| 5,281,167 | A * | 1/1994 | Le et al. | 439/578 |
| 5,284,449 | A * | 2/1994 | Vaccaro | 439/583 |
| 5,389,012 | A * | 2/1995 | Huang | 439/583 |
| 5,558,538 | A * | 9/1996 | Delalle | 439/583 |
| 5,651,698 | A | 7/1997 | Locati et al. | 439/578 |
| 5,769,662 | A | 6/1998 | Stabile et al. | 439/578 |
| 5,795,188 | A * | 8/1998 | Harwath | 439/583 |
| 6,159,046 | A * | 12/2000 | Wong | 439/578 |
| 6,183,298 | B1 | 2/2001 | Henningsen | 439/578 |
| 6,293,824 | B1 * | 9/2001 | Guerin et al. | 439/583 |
| 6,309,251 | B1 | 10/2001 | Tang | 439/584 |
| 6,733,336 | B1 * | 5/2004 | Montena et al. | 439/578 |
| 6,802,738 | B1 | 10/2004 | Henningsen | 439/583 |
| 6,802,739 | B2 | 10/2004 | Henningsen | 439/584 |
| 6,939,169 | B2 | 9/2005 | Islam et al. | 439/578 |
| 6,955,562 | B1 | 10/2005 | Henningsen | 439/578 |
| 7,121,883 | B1 * | 10/2006 | Petersen et al. | 439/582 |
| 2005/0020129 | A1 | 1/2005 | Dykstra et al. | 439/578 |
| 2005/0026496 | A1 | 2/2005 | Islam et al. | 439/578 |
| 2006/0199431 | A1 | 9/2006 | Paynter | 439/578 |

FOREIGN PATENT DOCUMENTS

| | | | |
|---|---|---|---|
| DE | 1905182 | | 2/1969 |
| EP | 1122835 | A1 | 2/2000 |
| EP | 1303005 | A1 | 10/2001 |
| EP | 1555730 | A1 | 11/2004 |
| WO | WO2005/004290 | A1 | 1/2005 |
| WO | WO2005/027276 | A1 | 3/2005 |

* cited by examiner

*Primary Examiner*—Tulsidas C. Patel
*Assistant Examiner*—Phuongchi Nguyen
(74) *Attorney, Agent, or Firm*—James Beyer; Joseph M. Homa

(57) ABSTRACT

A coaxial cable connector assembly is provided wherein a center contact clamping mechanism of the connector assembly is configured to cooperate with a cable adapter and a center contact of the connector assembly such that movement of the clamping mechanism in the direction of the cable adapter results in compression of the center contact about an end portion of the center conductor of the coaxial cable.

22 Claims, 14 Drawing Sheets

COMPRESSION CONNECTOR

BACKGROUND OF THE INVENTION

The present invention relates generally to coaxial cable connectors and, more particularly to cable connectors configured to provide reliable conductive coupling to the conductive elements of a coaxial cable.

SUMMARY OF THE INVENTION

Generally, the present invention relates to the provision of a coaxial cable connector that includes a clamping mechanism for compressing a center contact about an end portion of a center conductor of a coaxial cable.

According to one embodiment of the present invention, a coaxial cable connector assembly is provided wherein a center contact clamping mechanism of the connector assembly is configured to cooperate with a cable adapter and a center contact of the connector assembly such that movement of the clamping mechanism in the direction of the cable adapter results in compression of the center contact about an end portion of the center conductor of the coaxial cable and compression of the center contact about the center conductor is independent of relative movement between the center contact and the center conductor.

According to another embodiment of the present invention, the center contact clamping mechanism comprises a compressive insulator and a conductive fitting configured to conductively engage the outer conductor of the coaxial cable. A sleeve portion of the center contact defines a tapered cross section and an inner diameter of the compressive insulator is at least as large as the minimum outer diameter of the sleeve and is smaller than the maximum outer diameter of the sleeve.

According to yet another embodiment of the present invention, the conductive fitting and the compressive insulator cooperate to define a reducible inner diameter. The reducible inner diameter decreases with movement of the fitting along the axis of the center contact in the direction of the cable adapter.

According to a further embodiment of the present invention, the center contact clamping mechanism includes a clamping sleeve in addition to an insulator and the conductive fitting. The inner diameter of the clamping sleeve is smaller than the maximum outer diameter of the tapered sleeve portion of the center contact. The clamping sleeve can be urged over the sleeve portion to forcibly compress the sleeve portion about the center conductor of the coaxial cable. For the purposes of describing and defining the present invention, it is noted that the term "about" is recited herein to denote a relationship where one element is positioned to engage the outer surface, or at least a portion of the outer surface of another element, either directly or indirectly.

According to an additional embodiment of the present invention, a method of electrically coupling a connector assembly according to the present invention to a coaxial cable is provided.

Additional features and advantages of the invention will be set forth in the detailed description which follows, and in part will be readily apparent to those skilled in the art from that description or recognized by practicing the invention as described herein, including the detailed description, the claims, as well as the appended drawings. For example, the configuration of the connector is environmentally friendly in that it allows for secure, solderless, lead-free coupling of the cable conductors to the contacts of the connector.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention and, together with the description, serve to explain the principles and operations of the invention.

BRIEF DESCRIPTION OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
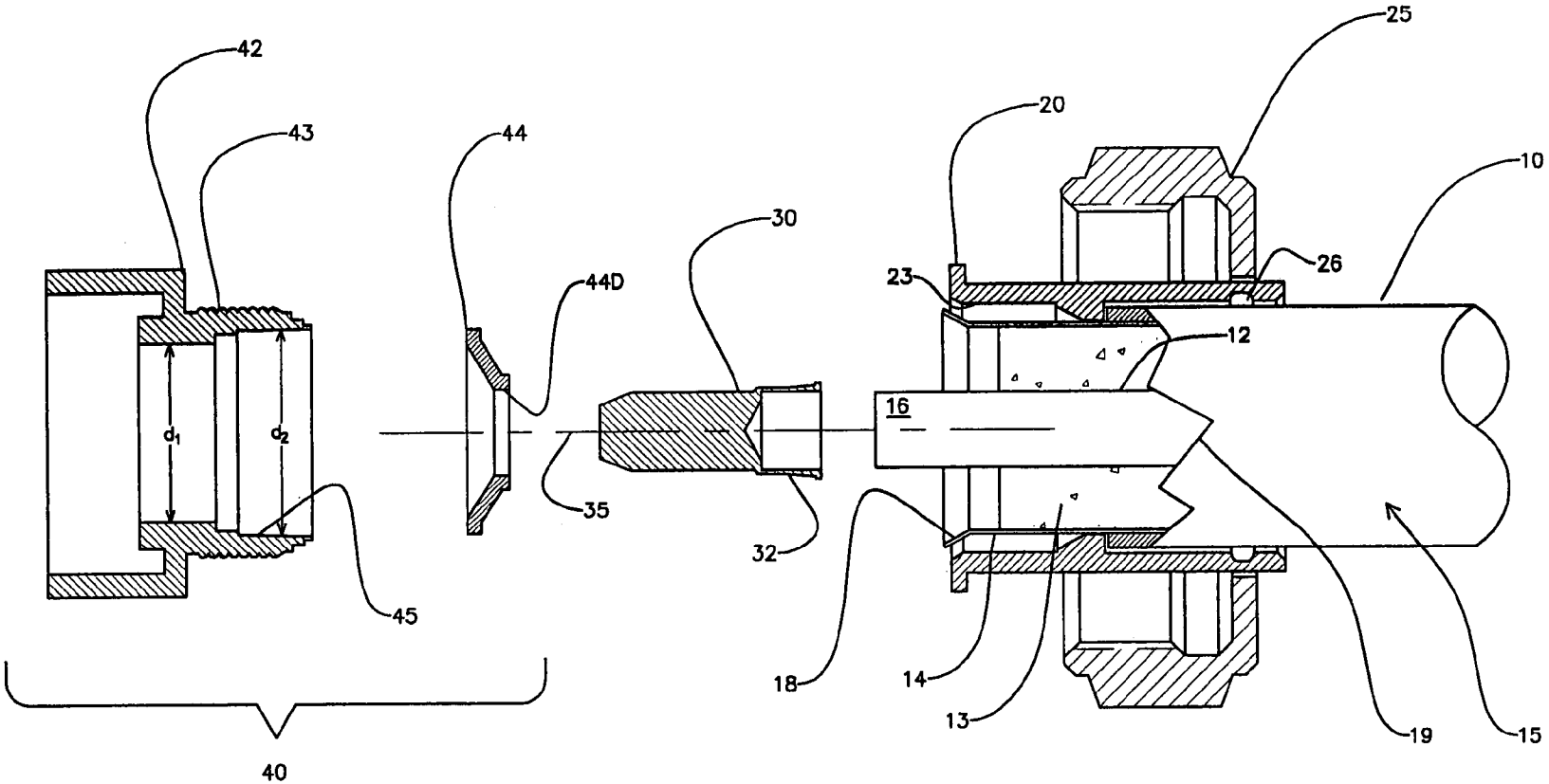
FIG. 1 is a partially assembled view of a connector assembly according to a first embodiment of the present invention.
Figure 2:
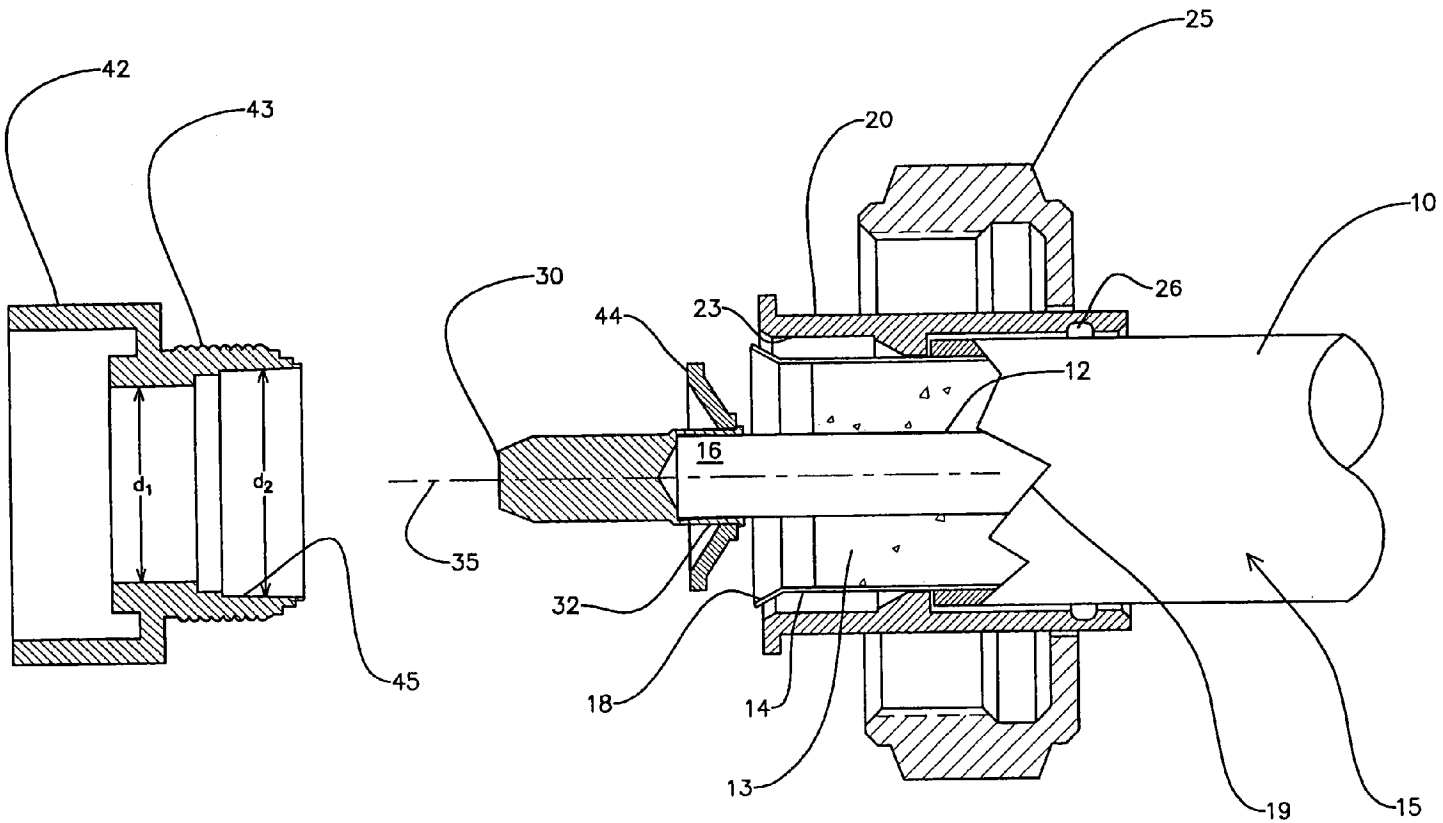
FIG. 2 is a more fully assembled illustration of the connector assembly of FIG. 1.
Figure 3:
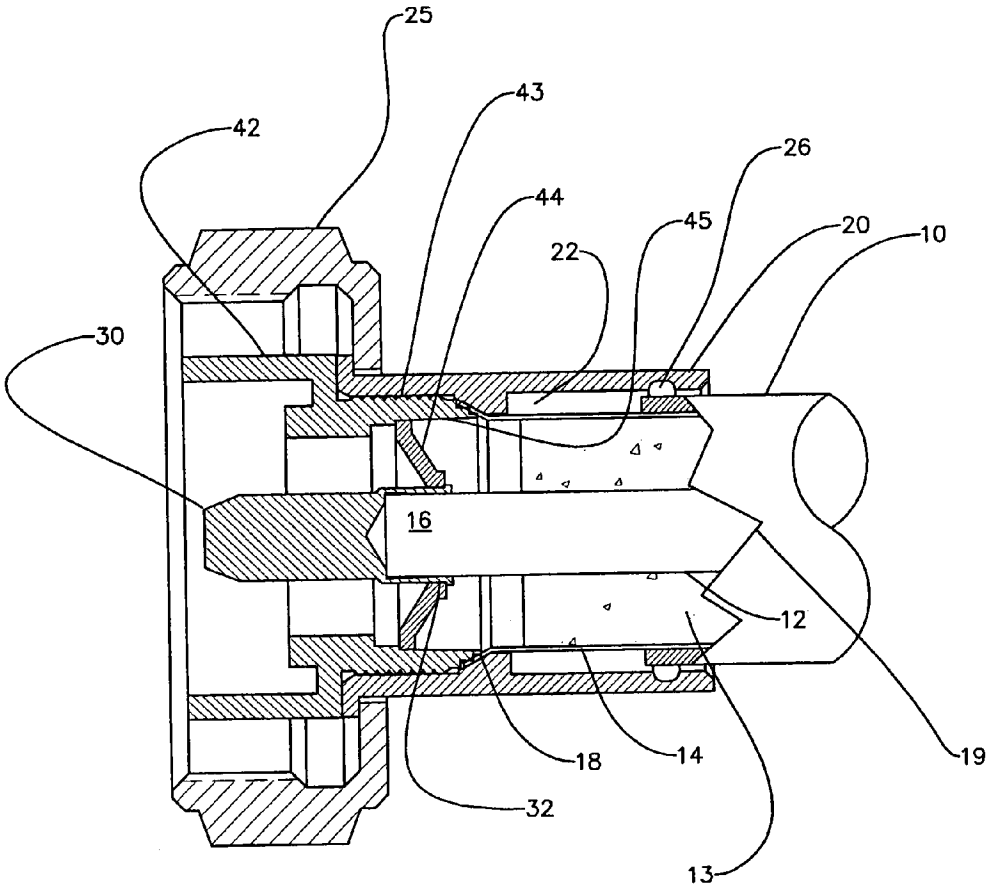
FIG. 3 is an assembled illustration of the connector assembly of FIGS. 1 and 2.

Referring initially to FIGS. 1–3, a connector assembly according to one embodiment of the present invention is illustrated. Generally, connector assemblies according to the present invention are configured to provide an electrically conductive coupling to a coaxial cable 10. The design particulars of the coaxial cable 10 are beyond the scope of the present invention and, for the purposes of describing and defining the present invention, it is sufficient to note that the cable 10 comprises a center conductor 12, an outer conductor 14, and a dielectric 13 disposed there between.

As will be described in further detail below, the connector assembly comprises a cable adapter 20, a center contact 30, and a center contact clamping mechanism 40. The cable adapter 20 is configured to surround the end portion 15 of the coaxial cable 10 and may include a coupling nut 25 that may be threaded and be configured, for example, to secure the connector assembly to a threaded electrical terminal. The center contact 30 is configured to engage the center conductor 12 of the coaxial cable 10 and define an electrically conductive coupling thereto in the manner illustrated in FIGS. 2 and 3. The center contact comprises a conductive sleeve portion 32 that at least partially surrounds an end portion 16 of the center conductor 12. The center contact clamping mechanism 40 is comprised of a conductive fitting 42 and a compressive insulator 44. In the embodiment illustrated in FIGS. 1–3, the conductive fitting 42 is configured to engage the cable adapter 20, securing the clamping mechanism 40 to the end portion 15 of the coaxial cable 10. FIG. 1 shows the adapter 20 mounted on the end portion 15 of the coaxial cable 10.

Comparing the partially assembled state of FIG. 2 with the fully assembled state of FIG. 3, it is noted that the center contact clamping mechanism 40 is further configured to cooperate with the cable adapter 20 and the center contact 30 such that movement of the clamping mechanism 40 from the partially assembled state illustrated in FIG. 2 to the assembled state of FIG. 3, i.e., along a longitudinal axis 35 of the center contact 30 in the direction of the cable adapter 20, results in compression of the center contact 30 about the end portion 16 of the center conductor 12.

Typically, the center contact clamping mechanism 40 and the cable adapter 20 are configured to define a press-fit engagement. For example, the clamping mechanism 40 may comprise a conductive fitting 42 including a ridged outer surface 43 defining an outside diameter that is slightly larger than the inside diameter of a complementary inner surface 23 of the adapter 20. Particular embodiments of the present invention will require varying degrees of securement associated with the press fit engagement of the conductive fitting 42 and the cable adapter 20. For example, it may be necessary to fashion the conductive fitting 42 and the adapter 20 such that a compression tool is required to fully engage the fitting 42 and the adapter 20. At a minimum, the degree of securement associated with the press fit engagement of the conductive fitting 42 and the cable adapter 20 should be sufficient to ensure the fitting and adapter remain engaged as the cable/connector assembly is removed from the electrical terminal with which it is coupled. According to one embodiment of the present invention requiring tool-aided engagement of the fitting 42 and adapter 20, the diameter of the ridged outer surface 43 is about 0.004" larger than the inside diameter of a complementary inner surface 23 and the conductive fitting 42 and the adapter 20 are fabricated from brass or another similar metal and may be plated with, for example, nickel-tin, nickel, silver, chromate, white bronze, a copper-zinc-tin alloy, or any other suitable conductive plating.

The conductive fitting 42, the compressive insulator 44, the center contact 30, and the adapter 20 may be formed of a variety of materials, it is noted that, at a minimum, significant portions of the conductive fitting 42 and the center contact 30 will need to be formed of an electrically conductive material. In addition, it may be preferable to fabricate the center contact 30 from a relatively pliable conductive material to permit compression of the contact 30 about the center conductor 12 of the cable 10. It is also noted that the center contact 30 should also be characterized by a suitable degree of rigidity to allow it to effectively couple to a corresponding contact of the conductive terminal to which it is to be coupled. For example, the conductive fitting 42 may be a gold plated, nickel plated, or nickel-tin plated brass fitting. The center contact 30 may also be a gold plated, nickel plated, or nickel-tin plated brass conductor.

In the embodiment of FIGS. 1–3, the conductive sleeve portion 32 of the center contact 30 is radially compressible and comprises a tapered section having an outer diameter that increases in the direction of an open end of the sleeve portion 32. The clamping mechanism 40 comprises a conductive fitting 42 and a compressive insulator 44 that can be lodged within the conductive fitting 42. The compressive diametrical portion 44D of the compressive insulator 44 is smaller than an outer diameter defined by the tapered section of the center contact sleeve 32. Preferably, the point at which the diameter of the tapered section of the contact sleeve 32 begins to increase has a diameter that is roughly the same size as, or slightly smaller than, the inner diameter of the compressive diametrical portion 44D. However, it is contemplated that the compressive insulator 44 and the tapered section of the sleeve 32 can be sized such that the tapered section begins to increase in diameter from a size that is significantly smaller than the compressive diametrical portion 44D of the compressive insulator 44.

Because the tapered section has at least one diametrical portion having an outer diameter that is larger than the inner diameter of the compressive diametrical portion 44D, the tapered section of the center contact sleeve 32 can be radially compressed about the end portion 16 of the center conductor 12 without moving the sleeve along the surface of the center conductor 12. Stated differently, the compression of the center contact 30 about the center conductor 12 does not require relative axial movement between the center contact 30 and the center conductor 12. Compression of the center contact 30 is independent of relative movement between the center contact 30 and center conductor 12 in a direction substantially parallel to the longitudinal axis of the center contact 30.

Of course, it is contemplated that the configuration of the present invention does permit assembly where the center contact 30 does move along the surface of the center conductor 12. For example, the contact sleeve 32 could be compressed about the center conductor 12 before the center conductor 12 is fully inserted into the contact sleeve 32. In which case, engagement of the conductive fitting 42 and the adapter 20 would force the compressed center conductor 12 further into the contact sleeve 32 of the center contact 30. Similarly, It is contemplated that the configuration of the present invention also permits assembly where the center contact 30 moves along the surface of the center conductor 12 while the contact sleeve 32 is compressed about the center conductor 12.

As is noted above, according to one aspect of the present invention, the sleeve 32 may be compressed about the end portion 16 of the center conductor 12 while it remains stationary relative to the center conductor 12. To do so, the center conductor 12 is first inserted into the sleeve 32. Subsequently, the compressive insulator 44 is slid over the tapered section of the center contact sleeve 32 in the direction of the increasing diameters of the tapered section of the sleeve 12. The compressive insulator 44 is sufficiently rigid to ensure that the compressive diametrical portion 44D of the compressive insulator 44 does not yield to the increasing diameters of the tapered section of the sleeve 32.

Rather, the sleeve 32 yields to the compressive insulator 44, compressing the sleeve 32 about the center contact 12. According to this aspect of the present invention, compression of the center contact 12 is achieved without forcibly sliding the center contact sleeve 32 over the center conductor 12 as it is compressed. As a result, substantially all of the force required to slide the compressive insulator 44 over the tapered section of the center contact 30 is translated into compression of the center contact 30 about the center conductor 12. For the purposes of describing and defining the present invention, it is noted that our use of the term "substantially" in this context accounts for some loss of force due to friction between the compressive insulator 44 and the contact sleeve 32.

The slope and length of the tapered section of the contact sleeve 32 should be selected to ensure sufficient compression of the center conductor 12 and permit proper installation of the connector assembly of the present invention. For example, if the tapered section of the contact sleeve is designed with a slope that is too gradual or a length that is too short, the contact sleeve 32 will not sufficiently compress the center conductor 12. Conversely, if the tapered section of the contact sleeve is designed with a slope that is too steep and a length that is too long, it may be too difficult to slide the compressive insulator 44 over the contact sleeve 32. For the purposes of illustration, not limitation, according to one aspect of the present invention, the sleeve 32 defines a depth of about 4–5 mm and an inside diameter of about 5 mm. The tapered section of the sleeve defines a minimum outside diameter of about 6 mm, a maximum outside diameter of greater than about 6–7 mm, and a length of about 2–4 mm. Other embodiments will have dimensions tailored to different sized cables and/or interfaces.

As is illustrated in FIGS. 1–3, the compressive insulator 44 serves multiple purposes within the structure of the connector assembly of the present invention. Specifically, as is noted above, the compressive insulator 44 serves to enhance the degree of conductive coupling between the center contact 30 and the center conductor 12 of the coaxial cable 10 by compressing the contact 30 about the conductor 12. In addition, the compressive insulator 44 stabilizes the center contact 30 in a proper position relative to the conductive fitting 42, i.e., concentric with the central axis of the connector assembly. Finally, the compressive insulator 44 serves to isolate electrically the center contact 30 from the conductive fitting 42. Similar functionality is represented in the other embodiments of the present invention described herein. Significantly, the various connector assembly configurations of the present invention can be configured such that the compressive insulator 44 serves as the sole source of support and electrical isolation within the conductive fitting 42 for the center contact 30. As a result, according to this aspect of the present invention, the connector assembly presents only one hardware component in addition to the cable adapter 20 and electrically conductive contacts, which contacts are embodied in the center contact 30 and conductive fitting 42.

Referring further to the embodiment illustrated in FIGS. 1–3, it is noted that the outer conductor 14 of the coaxial cable 10 includes a flared end portion 18 that is sandwiched between the conductive fitting 42 and the adapter 20 when the fitting 42 and adapter 20 are fully engaged. In this manner, the present invention provides a secure electrical coupling between the outer conductor 14 and the conductive fitting 42 and provides mechanical securement of the connector assembly on the cable 10. Regarding the manner in which the flared end portion is provided, it is noted that the flared end portion 18 can be formed with conventional tooling during installation of the connector assembly. Alternatively, it is contemplated that the flared end portion 18 can be formed prior to installation of the connector assembly, provided the adapter can be subsequently installed over an opposite end of the cable 10 or in some other manner that would not require the adapter 20 to be installed over the cable end portion 15.

The connector assembly of the present invention is coupled to the coaxial cable 10 by first preparing the coaxial cable for coupling or providing a prepared coaxial cable 10. To prepare the coaxial cable 10, the outermost layer of the cable, i.e., the cable jacket 19, the outer conductor 14, and the dielectric 13 are cut to expose the center conductor 12. Next, the cable jacket 19 is cut again further back along the length of the cable 10 to expose a portion of the outer conductor 14, as is illustrated in FIG. 1. Subsequently, a portion of the cable dielectric 13 is cored out to expose an inner surface of the outer conductor 14. The exposed portions of the center and outer conductors 12, 14 may also be exposed to specific cleaning steps to remove nonconductive residue from these conductive elements.

Referring to FIG. 1, once the cable 10 is prepared for coupling, the cable adapter 20 is installed onto the end portion 15 of the cable 10 by disposing the coaxial cable 10 in the throughbore of the adapter 20. For convenience of illustration, it is noted that the cable adapter 20 can be described as comprising a front end oriented to the left in FIG. 1, a rear end oriented to the right in FIG. 1, and the inner throughbore extending between the front and rear ends. Care should be taken to ensure that front end of the adapter 20 is sufficiently set back to allow flaring of the outer conductor 14 to form the flared end portion 18 of the outer conductor 14. Referring to FIG. 2, the center contact 30 is coupled to the center conductor 12 by placing the rearward facing opening of the radially compressible tubular rear sleeve 32 over the end portion 16 of center conductor 12 and subsequently sliding the compressive insulator 44 over the tapered section of the sleeve 32.

Once the center contact 30 is coupled to the end portion 16 of the center conductor 12, the conductive fitting 42 can be press fit into secure engagement with the adapter 20 by sliding the adapter 20 into abutment with the flared portion 18 of the cable 10 and inserting the conductive fitting 42 into the open end portion of the adapter 20. For the purposes of describing and defining the present invention, it is noted that the conductive fitting 42, which may also be described as a bushing 42 comprising the ridged outer surface 43, an internal surface 45, a front portion with a front end oriented to the left in FIGS. 1–3, and a rear portion with a rear end oriented to the right in FIGS. 1–3. The rear portion of the bushing 42 is configured to matingly fit within the inner throughbore of the adapter 20 to engage the inner surface 23 of the adapter 20. The bushing 42 also defines an internal throughbore extending between the front and rear ends of the bushing 42. This throughbore includes a relatively small diametrical portion $d_1$ and a slightly larger diametrical portion $d_2$. A stepped gradient between the relatively small diametrical portion $d_1$ and the slightly larger diametrical portion $d_2$ defines a pair of shoulders, either of which can function as a stop to forward axial movement of the insulator 44 within the fitting 42. As will be appreciated by those practicing the present invention, the stepped gradient can be configured to define a single shoulder or multiple shoulders of respectively decreasing internal diameters. In addition the diametrical portion $d_2$ can be configured to define a decreasing taper, as is illustrated in FIGS. 1 and 2.

As the conductive fitting 42 is inserted into the open end of the adapter 20, the ridged outer surface 43 of the fitting 42 engages the inner surface 23 of the adapter 20 in a press-fit engagement, as is described above and illustrated in FIG. 3. It is noted that the cable 10, along with center contact 30, can be retracted into the adapter 20, engaging the flared portion 18 of the cable 10 with a complementary flared portion 18 of the adapter 20, either before the fitting 42 is engaged with the adapter 20 or simultaneous with engagement of the fitting 42 and the adapter 20.

Figure 13:
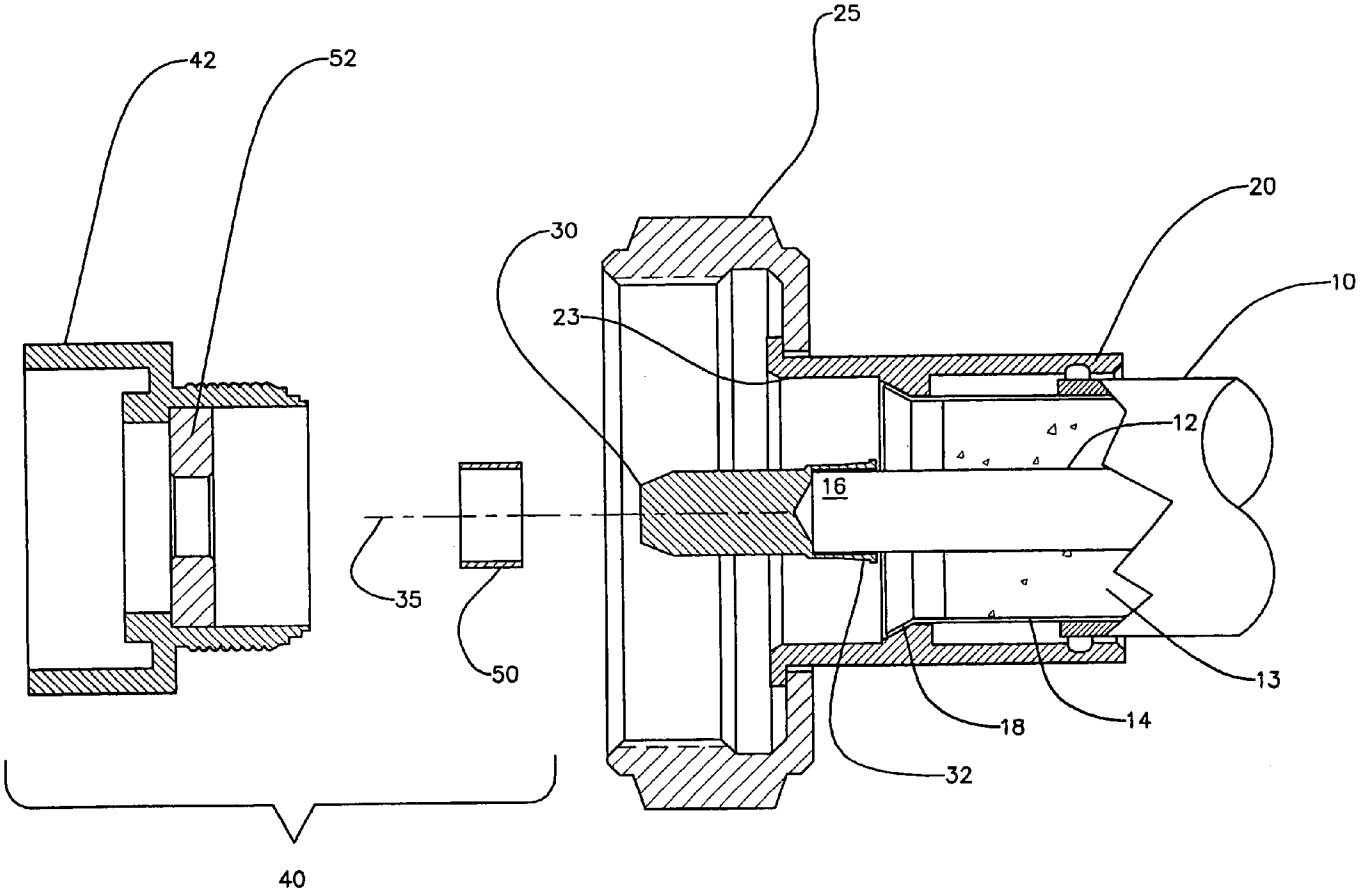
FIG. 13 is a partially exploded view of a connector assembly according to a further embodiment of the present invention.
Figure 14:
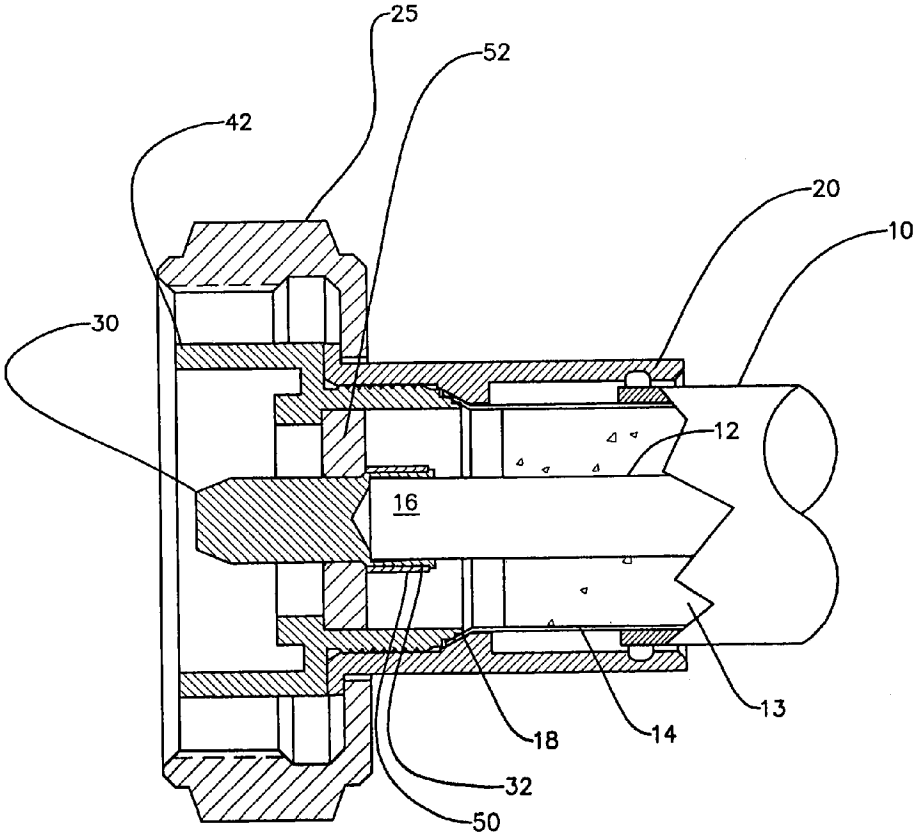
FIG. 14 is an assembled illustration of the connector assembly of FIG. 13.

The manner in which the connector assembly of the present invention is coupled to the coaxial cable 10 has been illustrated herein with reference to the embodiment of FIGS. 1–3. However, it is noted that analogous coupling steps will also be effective for the remaining embodiments illustrated herein, with the exception that the compressive insulator 44 is, in some cases, installed over the tapered section of the sleeve 32 as the fitting 42 is engaged with the adapter 20 (see FIGS. 11 and 12), or after the fitting is engaged with the adapter 20 (see FIGS. 6–9). In the embodiment of FIGS. 13 and 14, the compressive insulator is replaced with a clamping sleeve 50 that can be installed over the tapered section of the sleeve 32 as the fitting 42 is engaged with the adapter 20 or after the fitting is engaged with the adapter 20. For the purposes of describing and defining the present invention, it is noted that the clamping sleeve 50 may also be referred to as a ferrule and may take a variety of forms in addition to that of a uniform cylindrical sleeve.

Figure 4B:
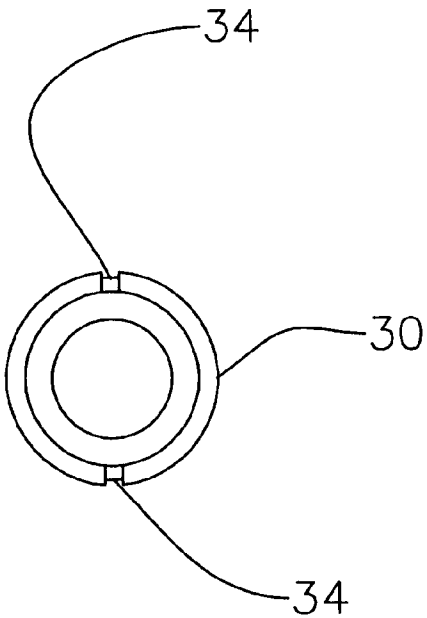
FIGS. 4A and 4B illustrate a center contact suitable for use in a connector assembly according to the present invention.
Figure 4A:
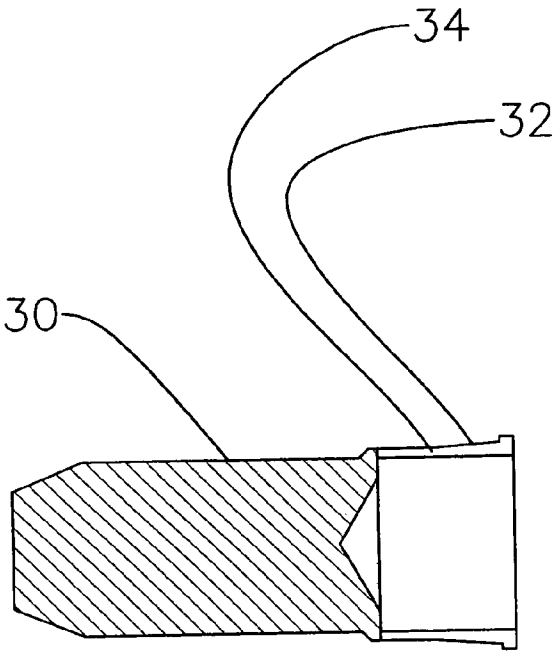
Figure 5:
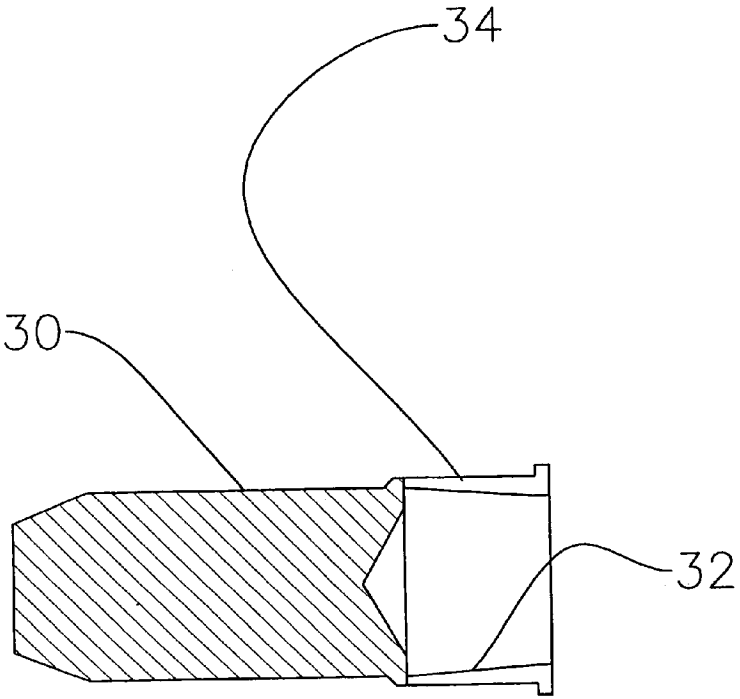
FIG. 5 illustrates an alternative center contact suitable for use in a connector assembly according to the present invention.

FIGS. 4A and 4B illustrate the structure of a center contact 30 according to an aspect of the present invention where one or more longitudinal compression slots 34 are formed in the center contact 30. The compression slots 34 can be used to help ensure that the sleeve portion 32 can more freely compress about the end portion 16 of the center conductor 12, and to do so to a degree that might not otherwise be possible if the slots 34 were not present. Although the tapered section of the contact sleeve 32 illustrated in FIGS. 1–4 comprises an increasing outer diameter along the axial direction, it is contemplated that, in another embodiment of the present invention, the tapered section may be alternatively or additionally provided by decreasing the inner diameter of the sleeve 32 in the direction of its open end, as is illustrated in FIG. 5.

As we noted above, the clamping mechanism 40 comprises a conductive fitting 42 and a compressive insulator 44 that can be lodged within the conductive fitting 42. This lodged state can be enhanced by at least a portion of the compressive insulator 44 having an outer diameter that is larger than the inner diameter of at least a portion of the conductive fitting 42. In the embodiment of FIGS. 1–3, the conductive fitting 42 comprises a tapered section 45 having an inner diameter that decreases from a value at least as large as the outer diameter of the compressive insulator 44 to a value as small as or smaller than the outer diameter of the compressive insulator 44.

Figure 6:
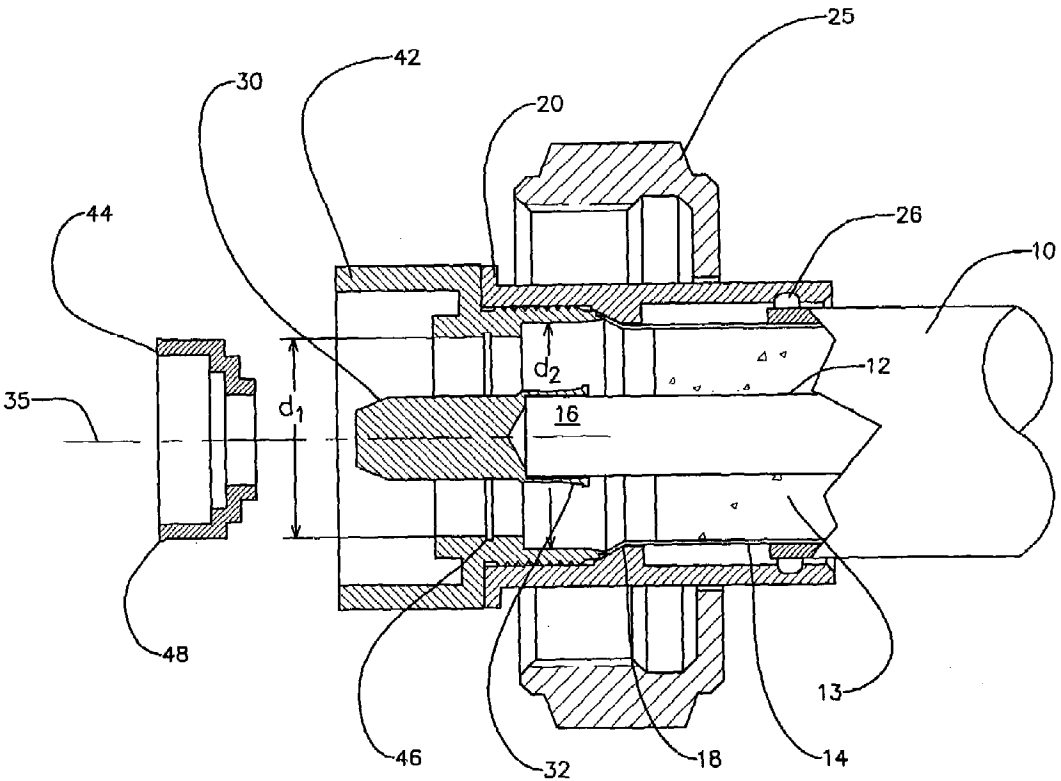
FIG. 6 is a partially assembled view of a connector assembly according to another embodiment of the present invention.
Figure 7:
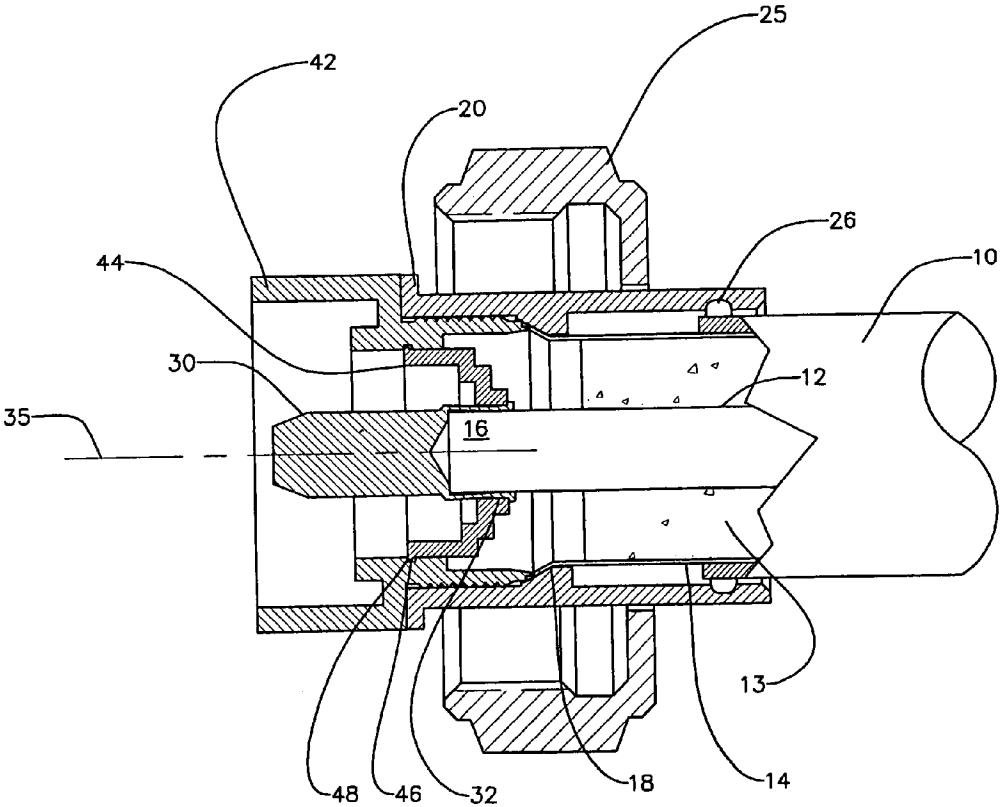
FIG. 7 is an assembled illustration of the connector assembly of FIG. 6.

Referring to FIGS. 6 and 7, the lodged state can be enhanced by alternatively or additionally providing an annular recess 46 in the inner diameter of the fitting 42 and a complementary annular projection 48 on the outside diameter of the compressive insulator 44. In this configuration, as is illustrated in FIG. 7, the compressive insulator 44 can be essentially snap-fit into engagement with the fitting 42 by sliding the annular projection 48 along the inner diameter of the fitting 42 until it is lodged into the space provided by the annular recess 46. In practicing the present invention, it should be clear that the compressive insulator 44 can be lodged within the conductive fitting 42 in a variety of manners including, but not limited to, configurations where the insulator 44 is lodged within the conductive fitting 42 in a nested relationship or via a taper 45 (see FIG. 1) or an annular recess 46 provided in an inner diameter of the fitting 42. In some embodiments such as those shown in FIGS. 6–7, the end of the compressive insulator 44 facing away from the cable is deflected radially inwardly as it passes through internal bore of diameter d, of fitting 42 and then that end of the insulator deflects radially outwardly and into engagement with fitting 42 in recess 46. When finally positioned within recess 46, projection 48 returns to its original diameter, or a fraction of its original diameter, prior to deflection radially inwardly and insertion of 44 into fitting 42.

Figure 8:
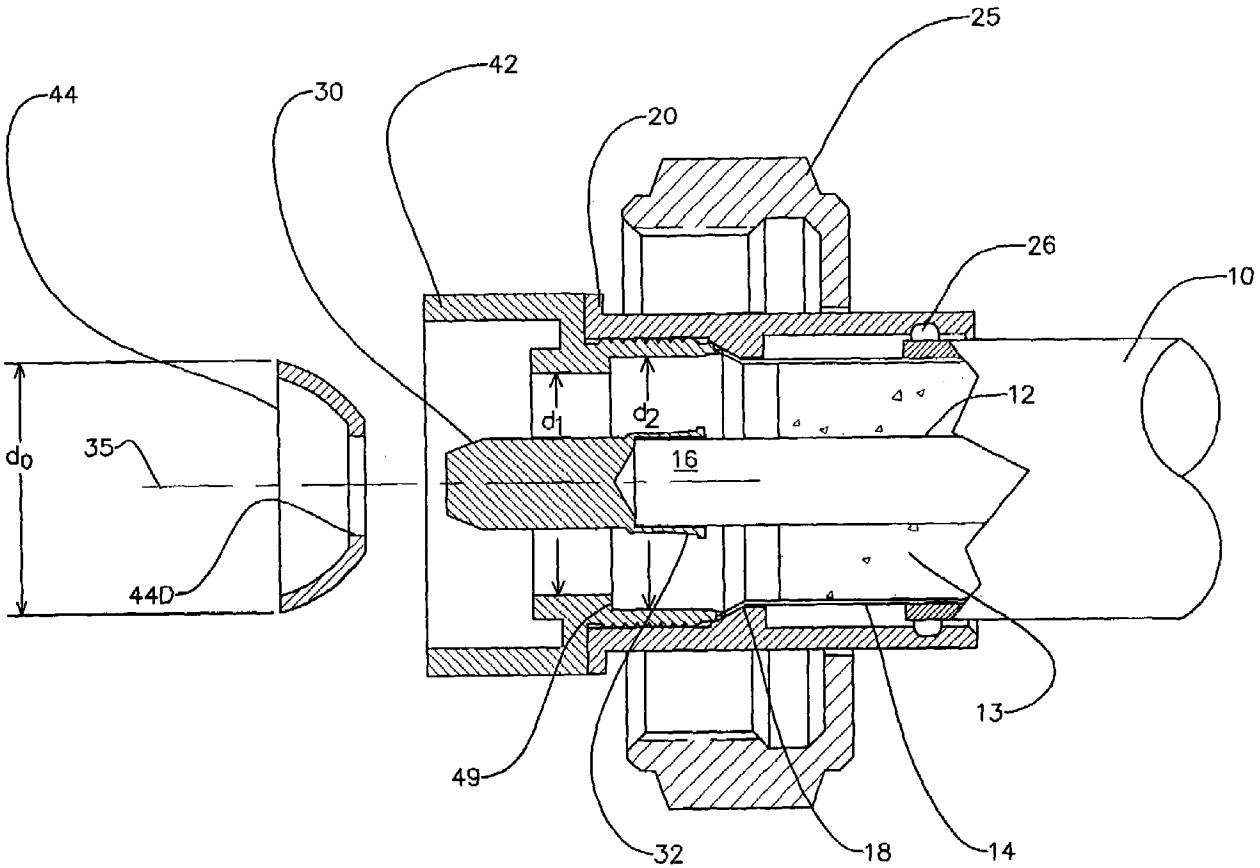
FIG. 8 is a partially assembled view of a connector assembly according to yet another embodiment of the present invention.
Figure 9:
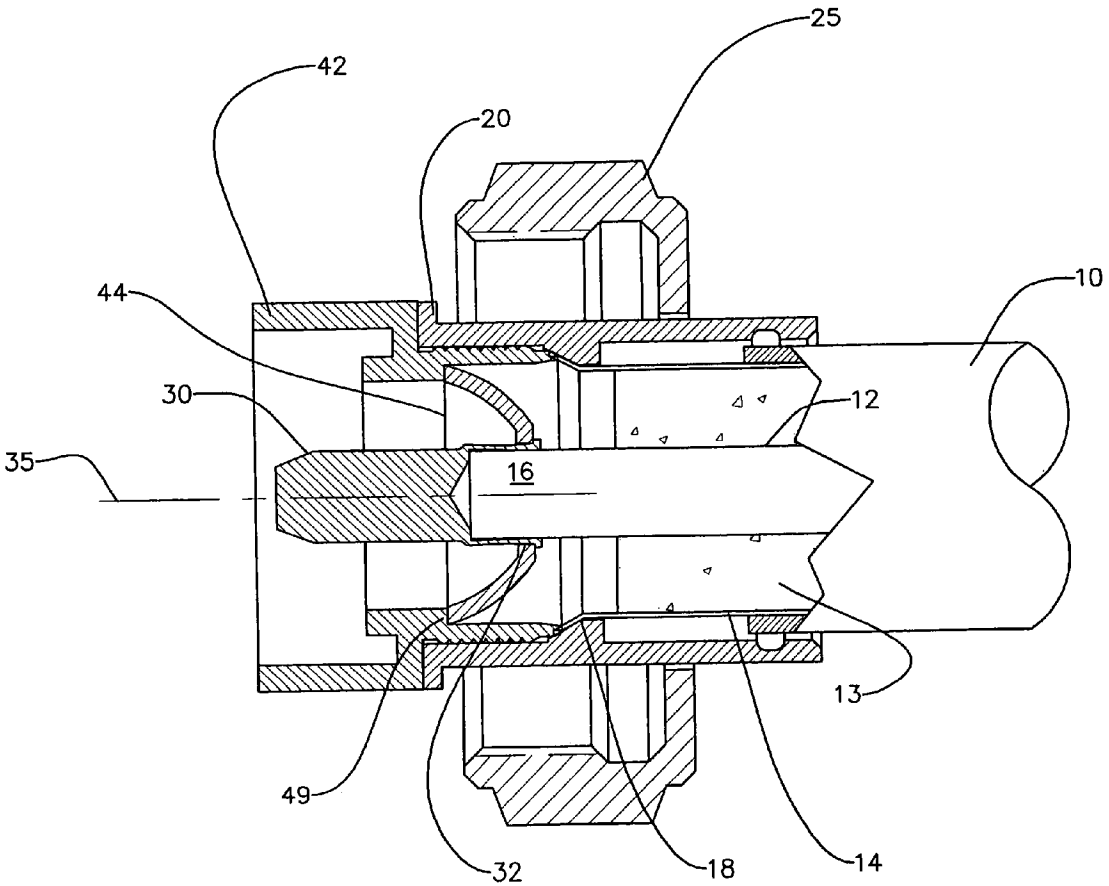
FIG. 9 is an assembled illustration of the connector assembly of FIG. 8.
Figure 10B:
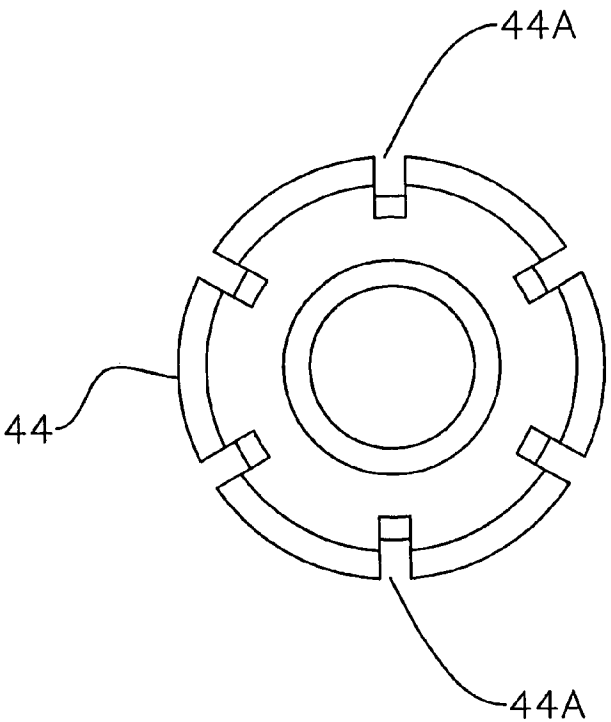
FIGS. 10A and 10B illustrate a compressive insulator suitable for use in a connector assembly according to the present invention.
Figure 10A:
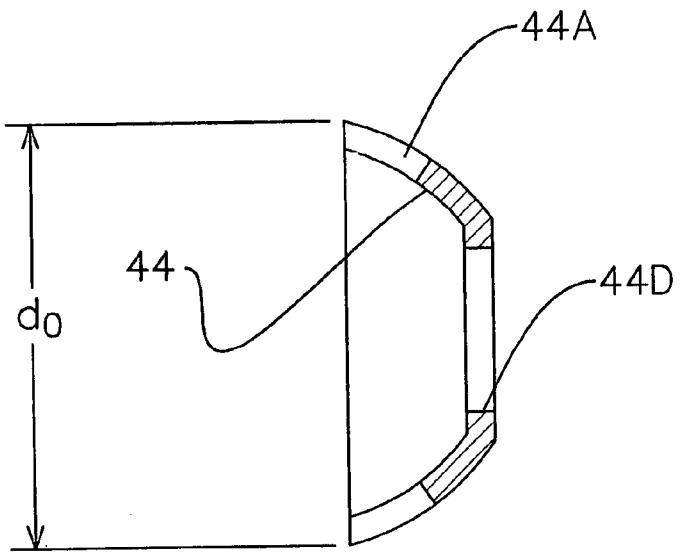

FIGS. 8 and 9 illustrates an alternative embodiment of the present invention where the compressive insulator 44 is configured such that it can be lodged within the conductive fitting 42. More specifically, the insulator 44 has an outer diameter that is larger than an inner diameter of the fitting 42 and is characterized by a profile and degree of flexibility that allows it to be urged through a relatively small diametrical portion d, of the fitting 42 to be introduced into and lodged within a slightly larger diametrical portion $d_2$ of the fitting 42. As is illustrated in FIGS. 10A and 10B, the compressive insulator 44 may be provided with compression slots 44A to enhance the diametrical flexibility of the compressive insulator and its ability to be urged through the relatively small diametrical portion $d_1$ of the fitting 42. As is the case with the other compressive insulators described above, the tapered section of the contact sleeve 32 illustrated comprises increasing outer diameters and the compressive diametrical portion 44D of the compressive insulator 44 is smaller than at least a portion of the increasing outer diameters defined by the tapered section of the center contact sleeve 32. As a result, the compressive insulator can forcibly compress the sleeve portion 32 of the center contact 30 about the center conductor 12 of the axial cable 10 as it is urged along the sleeve portion 32 in the direction of the open end of the sleeve portion 32.

In some embodiments such as those shown in FIGS. 8–9, the end of insulator 44 facing away from the cable is deflected radially inwardly sufficient to allow insulator 44 to pass entirely through the relatively small diametrical portion d, of the fitting 42. In which case, the insulator 44 has the resiliency to deflect radially outwardly to a diameter matching that of the slightly larger diametrical portion $d_2$ of the fitting 42, or at least to a diameter that is large enough to allow the end of the insulator 44 facing away from the cable to engage the rearward facing shoulder 49 of the fitting 42. Stated differently, the compressible outer diameter do of the insulator 44 should be smaller than the relatively small diametrical portion d, of the fitting 42 but can be larger than, equal to, or less than the slightly larger diametrical portion $d_2$ of the fitting 42. In this manner, as is illustrated in FIGS. 8 and 9, the shoulder 49 of the fitting 42 functions as a stop to forward axial movement of the insulator 44 within the fitting 42.

Figure 11:
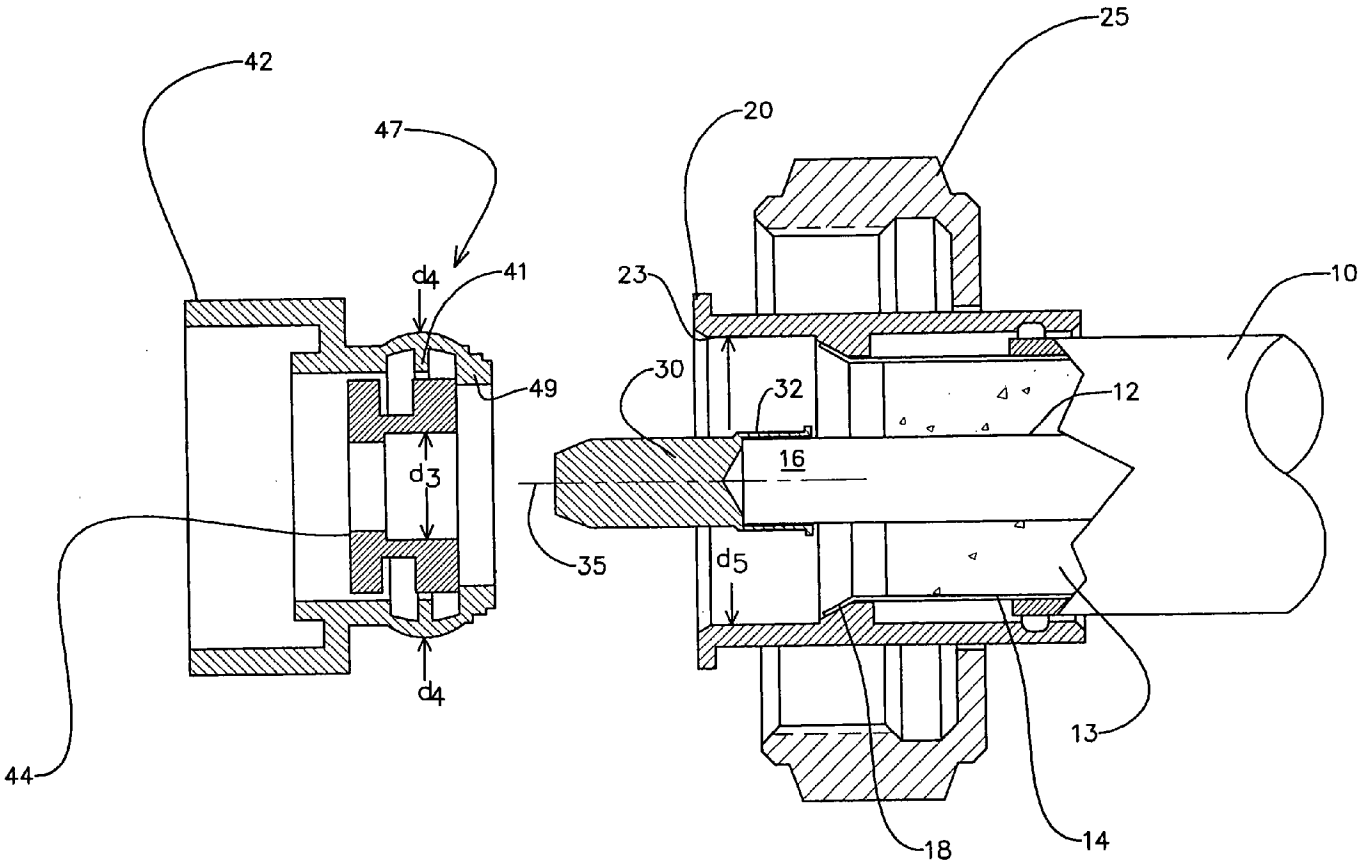
FIG. 11 is a partially assembled view of a connector assembly according to an additional embodiment of the present invention.
Figure 12:
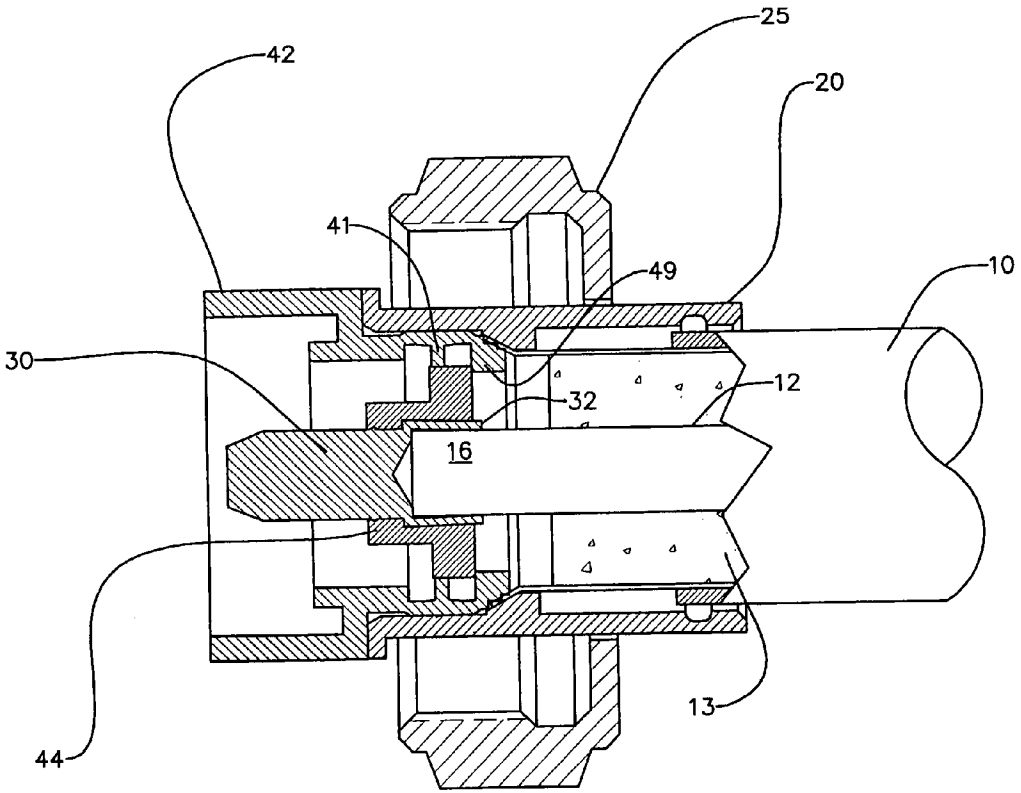
FIG. 12 is an assembled illustration of the connector assembly of FIG. 11.

FIGS. 11 and 12 illustrate an alternative embodiment of the present invention where the conductive fitting 42 and the compressive insulator 44 cooperate to define a reducible inner diameter $d_3$. The reducible inner diameter $d_3$ decreases with movement of the fitting 42 along the axis of the center contact 30 in the direction of the cable adapter 20. At its largest (see FIG. 11), the reducible inner diameter $d_3$ is at least as large as an outer diameter of the sleeve portion 32. At its smallest (see FIG. 12), the reducible inner diameter $d_3$ is small enough to enable compression of the sleeve 32 about the center conductor 12. The conductive fitting 42 comprises a compressible portion 47 having a reducible outer diameter $d_4$ that is initially larger than an inner diameter $d_5$ of the cable adapter 20 (see FIG. 11). The outer diameter $d_4$ subsequently decreases as the fitting 42 engages the adapter 20 (see FIG. 12). The conductive fitting 42 and the compressive insulator 44 are configured such that a decrease in the reducible outer diameter $d_4$ of the compressible portion 47 of the fitting 42 causes an inward protrusion 41 of the fitting 42 to engage and maintain contact with the outer surface of the compressive insulator 44 as the fitting 42 engages the adapter 20.

As is illustrated in FIGS. 11 and 12, the compressible portion 47 is configured to define a curved profile but it is contemplated that it may be configured to define any sloped profile or to cooperate with a corresponding sloped or curved profile on the complementary inner surface 23 of the adapter 20 such that the degree of engagement between the inward protrusion 41 of the fitting 42 and the outer surface of the compressive insulator 44 increases as the fitting 42 engages the adapter 20 and is maintained after full assembly. The decrease in the reducible inner diameter $d_3$ of the compressive insulator 44 compresses the sleeve 32 into mechanical and electrical contact with the center conductor 12, as is illustrated in FIG. 12. In the embodiment shown in FIGS. 11 and 12, the internal surface of the fitting 42 comprises a shoulder 49, which provides an axial stop to rearward axial movement of the insulator 44 within the fitting 42.

FIGS. 13 and 14 illustrate an alternative embodiment of the present invention where the center contact clamping mechanism 40 includes a clamping sleeve 50 in addition to an insulator 52, and conductive fitting 42. As was the case for some of the embodiments described previously, the sleeve portion 32 of the center contact 30 comprises a tapered section. The inner diameter of the clamping sleeve 50 is at least as large as the minimum outer diameter of the sleeve portion 32 of the center contact 30 and is smaller than the maximum outer diameter of the sleeve portion 32 of the center contact 30. In this manner, the clamping sleeve 50 can be urged over the sleeve portion 32 to forcibly compress the sleeve portion 32 into contact with the center conductor 12 of the coaxial cable 10. As is illustrated in FIGS. 10 and 11, the conductive fitting 42, the insulator 52, and the clamping sleeve 50 are configured such that the clamping sleeve 50 can be lodged within the insulator 52 and the insulator 52 can be lodged within the conductive fitting 42. The portion of the insulator 52 in contact with the internal circumferential surface of the fitting 42 is disposed forward of the clamping sleeve 50 and prevents forward movement of the sleeve 50.

For the purposes of describing and defining the present invention, it is noted that reference herein to conductive and insulating materials specifically denotes electrically conductive and electrically insulating materials. Further, it is noted that objects defining inner or outer diameters need not comprise continuous inner or outer diameters. For example, referring to FIG. 10B, the compressive insulator 44 illustrated therein can be said to define an outside diameter despite the fact that the periphery of the insulator 44 is discontinuous. It is also noted that a number of elements of the various assemblies of the present invention are assembled in a "lodged" or "nested" relationship. For the purposes of defining and describing the present invention, it is noted that these terms merely require a close fit between the respective elements. The specific degree of precision required to achieve this close fit will vary depending upon the preferences of those practicing the present invention. Preferably, though not a requirement of the present invention, the fit should be close enough to allow convenient device assembly, without the aid of adhesives.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents. For example, although the center contact clamping mechanism is illustrated herein as a multi-component assembly, it is contemplated that the clamping mechanism can alternatively be formed as a unitary component, in which case the unitary component would be manufactured to include conductive and insulating portions.

Referring to FIG. 3, it is noted that a port may be provided in the cable adapter 20 to enable injection of an electrically insulating sealing material, e.g., silicon, in the adapter gap 22 formed between the adapter 20 and the cable 10. The port may be provided in a variety of manners, e.g., by providing a hole in the adapter 20 extending generally perpendicular to the axis of the center contact 30. In addition, the adapter 20 may be provided with an inner annular recess 22 sized and configured to permit insertion of an o-ring or similar sealing element between the adapter 20 and cable 10.

In one set of embodiments, a connector assembly is disclosed herein which is configured to provide an electrically conductive coupling to a coaxial cable comprising a center conductor and an outer conductor, said connector assembly comprising a cable adapter, a center contact, and a center contact clamping mechanism, wherein said cable adapter is configured to at least partially surround an end portion of said coaxial cable, said center contact is configured to conductively engage said center conductor of said coaxial cable and comprises a conductive sleeve portion configured to at least partially surround an end portion of said center conductor, said center contact clamping mechanism is configured to engage said cable adapter so as to secure said cable adapter and said clamping mechanism to said end portion of said coaxial cable, said center contact clamping mechanism is further configured to cooperate with said cable adapter and said center contact such that movement of at least a portion of said clamping mechanism along a longitudinal axis of said center contact in the direction of said cable adapter results in compression of said center contact about said end portion of said center conductor by a compressive member of said center contact clamping mechanism, and said center contact clamping mechanism and said center contact are configured to permit compression of said center contact about said center conductor independent of relative axial movement between said center contact and said center conductor.

In some embodiments, the conductive sleeve portion of said center contact defines a tapered cross section having an outer diameter that increases in the direction of an open end of said sleeve portion or an inner diameter that decreases in the direction of said open end of said sleeve portion.

In some embodiments, said compressive member comprises a compressive insulator; and said compressive insulator is configured to stabilize said center contact along a central axis of the connector assembly.

In some embodiments, said compressive member comprises a conductive fitting and a compressive insulator, and said compressive insulator configured to isolate electrically said center contact from said conductive fitting.

In some embodiments, said compressive member comprises a conductive fitting and a compressive insulator, and said compressive member is configured such that said compressive insulator serves as the sole source of support and electrical isolation within said conductive fitting for said center contact.

In some embodiments, said center contact clamping mechanism and said center contact are configured such that said compression is achieved with the center contact and the center conductor in a stationary state relative to each other.

In some embodiments, said center contact clamping mechanism and said center contact are configured such that said compression is achieved without forcibly sliding the center contact over the center conductor as the center conductor is compressed.

In some embodiments, said center contact clamping mechanism comprises a conductive fitting and a compressive insulator, and said compressive insulator is lodged within an inner diameter of said conductive fitting and said conductive fitting comprises a tapered cross sectional portion defining an inner diameter that decreases from a value at least as large as an outer diameter of said compressive insulator to a value as small as or smaller than the outer diameter of said compressive insulator in the direction of said open end of said sleeve portion.

In some embodiments, said center contact clamping mechanism comprises a conductive fitting and a compressive insulator, an inner diameter of at least a portion of said compressive insulator is smaller than an outer diameter of at least a portion of said sleeve portion of said center contact, and an outer diameter of at least a portion of said compressive insulator is larger than an inner diameter of at least a portion of said conductive fitting.

In some embodiments, said outer conductor of said coaxial cable comprises a flared end portion, and said center contact clamping mechanism and said cable adapter are configured such that said flared end portion is sandwiched between a conductive fitting of said center contact clamping mechanism and said cable adapter.

In some embodiments, said center contact clamping mechanism comprises a compressive insulator and a conductive fitting configured to conductively engage an outer conductor of said coaxial cable, said sleeve portion of said center contact defines a tapered cross section that defines an outer diameter that increases from a minimum sleeve outer diameter to a maximum sleeve outer diameter in the direction of an open end of said sleeve portion, and an inner diameter of at least a portion of said compressive insulator is at least as large as said minimum sleeve outer diameter and smaller than said maximum sleeve outer diameter such that said compressive insulator can forcibly compress said sleeve portion of said center contact about said center conductor of said axial cable as it is urged along said sleeve portion in the direction of said open end of said sleeve portion. In some of these embodiments, said compressive insulator, and said center contact are configured such that said compressive insulator can be lodged within said conductive fitting. In some of these embodiments, said compressive insulator is lodged within said conductive fitting in a nested relationship or via a taper or an annular recess provided in an inner diameter of said fitting.

In some embodiments, said center contact clamping mechanism comprises a compressive insulator and a conductive fitting configured to conductively engage an outer conductor of said coaxial cable, said conductive fitting and said compressive insulator cooperate to define a reducible inner diameter, and said reducible inner diameter decreases with movement of said fitting along said axis of said center contact in the direction of said cable adapter from a size that is at least as large as an outer diameter of said sleeve portion of said center contact. In some of these embodiments, said conductive fitting defines a compressible portion having a reducible outer diameter that can decrease from a size that is larger than an inner diameter defined by said cable adapter to a size that is smaller than said inner diameter of said cable adapter, and said conductive fitting and said compressive insulator are configured such that said reducible inner diameter of said compressive insulator decreases with said compressible portion having a reducible outer diameter of said conductive fitting.

In some embodiments, said center contact clamping mechanism comprises a clamping sleeve, an insulator, and a conductive fitting configured to conductively engage an outer conductor of said coaxial cable, said sleeve portion of said center contact defines a tapered cross section that defines an outer diameter that increases from a minimum sleeve outer diameter to a maximum sleeve outer diameter in the direction of an open end of said sleeve portion, and an inner diameter of said clamping sleeve is at least as large as said minimum sleeve outer diameter and smaller than said maximum sleeve outer diameter such that said clamping sleeve can forcibly compress said sleeve portion of said center contact about said center conductor of said axial cable as it is urged along said sleeve portion in the direction of said open end of said sleeve portion. In some of these embodiments, said conductive fitting, said insulator, and said clamping sleeve are configured such that said clamping sleeve can be lodged within said insulator and said insulator can be lodged within said conductive fitting.

In some embodiments, said connector assembly is conductively coupled to said center conductor and said outer conductor of said coaxial cable.

In another set of embodiments, a connector assembly is disclosed herein for use with a coaxial cable, the coaxial cable comprising a center conductor and an outer conductor, the connector assembly comprising: an adapter comprising a generally cylindrical inner surface, a front portion with a front end, and a rear portion with a rear end, wherein the inner surface defines an inner throughbore configured to receive the coaxial cable; a center contact comprising a body and a generally tubular rear sleeve, wherein the sleeve comprises an internal surface defining a rearward facing opening configured to receive the center conductor of the cable, and wherein the sleeve is radially compressible; a bushing comprising an outer surface, an internal surface, a front portion with a front end, and a rear portion with a rear end, wherein the internal surface defines an internal throughbore, the rear portion is configured to matingly fit within the inner throughbore of the adapter and engage the inner surface of the adapter; and an insulator member configured to contact the bushing and the sleeve, wherein the insulator member and the center contact are configured to compress the sleeve radially inwardly; wherein the rear portion of the bushing and the inner surface of the adapter are configured to compress the outer conductor of the cable.

In some embodiments, the coaxial cable is disposed in the inner throughbore of the adapter, a portion of the center conductor of the cable is disposed in the rearward facing opening of the center contact, the rear portion of the bushing and the inner surface of the adapter sandwich and compress a portion of the outer conductor of the cable, and the insulator member compresses the sleeve radially inwardly against the center conductor of the cable.

In another set of embodiments, a connector assembly is disclosed herein for use with a coaxial cable, the coaxial cable comprising a center conductor and an outer conductor, the connector assembly comprising: an adapter comprising a generally cylindrical inner surface, a front portion with a front end, and a rear portion with a rear end, wherein the inner surface defines an inner throughbore configured to receive the coaxial cable; a center contact comprising a body and a generally tubular rear sleeve, wherein the sleeve comprises an internal surface defining a rearward facing opening configured to receive the center conductor of the cable, and wherein the sleeve is radially compressible; a bushing comprising an outer surface, an internal surface, a front portion with a front end, and a rear portion with a rear end, wherein the internal surface defines an internal throughbore, the rear portion is configured to matingly fit within the inner throughbore of the adapter and engage the inner surface of the adapter; an insulator member having a portion in contact with the internal surface of the bushing and the center contact; and a ferrule surrounding the sleeve and compressing the sleeve radially inwardly against the center conductor of the cable; wherein the portion of the insulator in contact with the internal surface of the bushing insulator member is disposed forward of the ferrule and prevents forward movement of the ferrule.

In another set of embodiments, a method of electrically coupling a connector assembly to a coaxial cable is disclosed herein, wherein said connector assembly comprises a cable adapter, a center contact, and a center contact clamping mechanism, said method comprising:

positioning said cable adapter to at least partially surround an end portion of said coaxial cable; positioning said center contact such that a conductive sleeve portion of said center contact at least partially surrounds an end portion of a center conductor of said coaxial cable; and compressing said center contact about said end portion of said center conductor with a compressive member of said center contact clamping mechanism by engaging said center contact clamping mechanism with said cable adapter while maintaining a stationary relationship between said center contact and said center conductor. In some of these embodiments, said compression is effected without forcibly sliding said center contact over said center conductor as said center contact is compressed about said center conductor.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

What is claimed is:

1. A connector assembly configured to provide an electrically conductive coupling to a coaxial cable comprising a center conductor and an outer conductor, said connector assembly comprising a cable adapter, a center contact, and a center contact clamping mechanism, wherein:

said cable adapter is configured to at least partially surround an end portion of said coaxial cable;

said center contact is configured to conductively engage said center conductor of said coaxial cable and comprises a conductive sleeve portion configured to at least partially surround an end portion of said center conductor;

said center contact clamping mechanism is configured to engage said cable adapter so as to secure said cable adapter and said clamping mechanism to said end portion of said coaxial cable;

said center contact clamping mechanism is further configured to cooperate with said cable adapter and said center contact such that movement of at least a portion of said clamping mechanism along a longitudinal axis of said center contact in the direction of said cable adapter results in compression of said center contact about said end portion of said center conductor by a compressive member of said center contact clamping mechanism;

said center contact clamping mechanism and said center contact are configured to permit compression of said center contact about said center conductor independent of relative axial movement between said center contact and said center conductor;

said compressive member comprises a conductive fitting and a compressive insulator; and said compressive insulator configured to isolate electrically said center contact from said conductive fitting.

2. A connector assembly as claimed in claim 1 wherein said conductive sleeve portion of said center contact defines a tapered cross section having an outer diameter that increases in the direction of an open end of said sleeve portion or an inner diameter that decreases in the direction of said open end of said sleeve portion.

3. A connector assembly as claimed in claim 1 wherein:

said compressive insulator is configured to stabilize said center contact along a central axis of the connector assembly.

4. A connector assembly as claimed in claim 1 wherein:

said compressive member is configured such that said compressive insulator serves as the sole source of support and electrical isolation within said conductive fitting for said center contact.

5. A connector assembly as claimed in claim 1 wherein said center contact clamping mechanism and said center contact are configured such that said compression is achieved with the center contact and the center conductor in a stationary state relative to each other.

6. A connector assembly as claimed in claim 1 wherein said center contact clamping mechanism and said center contact are configured such that said compression is achieved without forcibly sliding the center contact over the center conductor as the center conductor is compressed.

7. A connector assembly as claimed in claim 1 wherein:

said compressive insulator is lodged within an inner diameter of said conductive fitting and said conductive fitting comprises a tapered cross sectional portion defining an inner diameter that decreases from a value at least as large as an outer diameter of said compressive insulator to a value as small as or smaller than the outer diameter of said compressive insulator in the direction of said open end of said sleeve portion.

8. A connector assembly as claimed in claim 1 wherein:

an inner diameter of at least a portion of said compressive insulator is smaller than an outer diameter of at least a portion of said sleeve portion of said center contact; and an outer diameter of at least a portion of said compressive insulator is larger than an inner diameter of at least a portion of said conductive fitting.

9. A connector assembly as claimed in claim 1 wherein:

said outer conductor of said coaxial cable comprises a flared end portion; and said center contact clamping mechanism and said cable adapter are configured such that said flared end portion is sandwiched between the conductive fitting of said center contact clamping mechanism and said cable adapter.

10. A coaxial cable comprising the connector assembly claimed in claim 1, wherein said connector assembly is conductively coupled to said center conductor and said outer conductor of said coaxial cable.

11. A connector assembly as claimed in claim 1 wherein:

said conductive fitting is configured to conductively engage an outer conductor of said coaxial cable;

said conductive fitting and said compressive insulator cooperate to define a reducible inner diameter; and said reducible inner diameter decreases with movement of said fitting along said axis of said center contact in the direction of said cable adapter from a size that is at least as large as an outer diameter of said sleeve portion of said center contact.

12. A connector assembly as claimed in claim 11 wherein:

said conductive fitting defines a compressible portion having a reducible outer diameter that can decrease from a size that is larger than an inner diameter defined by said cable adapter to a size that is smaller than said inner diameter of said cable adapter; and said conductive fitting and said compressive insulator are configured such that said reducible inner diameter of said compressive insulator decreases with said compressible portion having a reducible outer diameter of said conductive fitting.

13. A connector assembly as claimed in claim 1 wherein:

said center contact clamping mechanism comprises a clamping sleeve, and said conductive fitting is configured to conductively engage an outer conductor of said coaxial cable;

said sleeve portion of said center contact defines a tapered cross section that defines an outer diameter that increases from a minimum sleeve outer diameter to a maximum sleeve outer diameter in the direction of an open end of said sleeve portion;

an inner diameter of said clamping sleeve is at least as large as said minimum sleeve outer diameter and smaller than said maximum sleeve outer diameter such that said clamping sleeve can forcibly compress said sleeve portion of said center contact about said center conductor of said axial cable as it is urged along said sleeve portion in the direction of said open end of said sleeve portion.

14. A connector assembly as claimed in claim 13 wherein said conductive fitting, said insulator, and said clamping sleeve are configured such that said clamping sleeve can be lodged within said insulator and said insulator can be lodged within said conductive fitting.

15. A method of electrically coupling the connector assembly of claim 1 to a coaxial cable, said method comprising:

positioning said cable adapter to at least partially surround an end portion of said coaxial cable;

positioning said center contact such that a conductive sleeve portion of said center contact at least partially surrounds an end portion of a center conductor of said coaxial cable; and compressing said center contact about said end portion of said center conductor with a compressive member of said center contact clamping mechanism by engaging said center contact clamping mechanism with said cable adapter while maintaining a stationary relationship between said center contact and said center conductor.

16. A method as claimed in claim 15 wherein said compression is effected without forcibly sliding said center contact over said center conductor as said center contact is compressed about said center conductor.

17. A connector assembly as claimed in claim 1 wherein:

said conductive fitting is configured to conductively engage an outer conductor of said coaxial cable;

said sleeve portion of said center contact defines a tapered cross section that defines an outer diameter that increases from a minimum sleeve outer diameter to a maximum sleeve outer diameter in the direction of an open end of said sleeve portion; and an inner diameter of at least a portion of said compressive insulator is at least as large as said minimum sleeve outer diameter and smaller than said maximum sleeve outer diameter such that said compressive insulator can forcibly compress said sleeve portion of said center contact about said center conductor of said axial cable as it is urged along said sleeve portion in the direction of said open end of said sleeve portion.

18. A connector assembly as claimed in claim 17 wherein said conductive fitting, said compressive insulator, and said center contact are configured such that said compressive insulator can be lodged within said conductive fitting.

19. A connector assembly as claimed in claim 18 wherein said compressive insulator is lodged within said conductive fitting in a nested relationship or via a taper or an annular recess provided in an inner diameter of said fitting.

20. A connector assembly for use with a coaxial cable, the coaxial cable comprising a center conductor and an outer conductor, the connector assembly comprising:

an adapter comprising a generally cylindrical inner surface, a front portion with a front end, and a rear portion with a rear end, wherein the inner surface defines an inner throughbore configured to receive the coaxial cable;

a center contact comprising a body and a generally tubular rear sleeve, wherein the sleeve comprises an internal surface defining a rearward facing opening configured to receive the center conductor of the cable, and wherein the sleeve is radially compressible;

a bushing comprising an outer surface, an internal surface, a front portion with a front end, and a rear portion with a rear end, wherein the internal surface defines an internal throughbore, the rear portion is configured to matingly fit within the inner throughbore of the adapter and engage the inner surface of the adapter; and an insulator member configured to contact the bushing and the sleeve, wherein the insulator member and the center contact are configured to compress the sleeve radially inwardly;

wherein the rear portion of the bushing and the inner surface of the adapter are configured to compress the outer conductor of the cable.

21. A connector assembly as claimed in claim 20, in combination with a coaxial cable, wherein:

the coaxial cable is disposed in the inner throughbore of the adapter;

a portion of the center conductor of the cable is disposed in the rearward facing opening of the center contact;

the rear portion of the bushing and the inner surface of the adapter sandwich and compress a portion of the outer conductor of the cable; and the insulator member compresses the sleeve radially inwardly against the center conductor of the cable.

22. A connector assembly for use with a coaxial cable, the coaxial cable comprising a center conductor and an outer conductor, the connector assembly comprising:

an adapter comprising a generally cylindrical inner surface, a front portion with a front end, and a rear portion with a rear end, wherein the inner surface defines an inner throughbore configured to receive the coaxial cable;

a center contact comprising a body and a generally tubular rear sleeve, wherein the sleeve comprises an internal surface defining a rearward facing opening configured to receive the center conductor of the cable, and wherein the sleeve is radially compressible;

a bushing comprising an outer surface, an internal surface, a front portion with a front end, and a rear portion with a rear end, wherein the internal surface defines an internal throughbore, the rear portion is configured to matingly fit within the inner throughbore of the adapter and engage the inner surface of the adapter;

an insulator member having a portion in contact with the internal surface of the bushing and the center contact; and a ferrule surrounding the sleeve and compressing the sleeve radially inwardly against the center conductor of the cable;

wherein the portion of the insulator in contact with the internal surface of the bushing insulator member is disposed forward of the ferrule and prevents forward movement of the ferrule.

* * * * *